US006396013B1

(12) United States Patent
Kondo

(10) Patent No.: US 6,396,013 B1
(45) Date of Patent: May 28, 2002

(54) DOOR SWITCH WITH HERMETIC CAP HAVING AN INTEGRALLY MOLDED ABUTMENT PORTION WITH LOW FRICTION RESISTANCE

(75) Inventor: Hirofumi Kondo, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/613,905

(22) Filed: Jul. 11, 2000

(30) Foreign Application Priority Data

Jul. 15, 1999 (JP) ..... 11-201563

(51) Int. Cl.[7] ..... H01H 9/04; H01H 19/06

(52) U.S. Cl. ..... 200/302.3; 200/61.76

(58) Field of Search ..... 200/61.62–61.84, 200/302.1–302.3, 333

(56) References Cited

U.S. PATENT DOCUMENTS 2,451,176 A * 10/1948 Schellman ..... 200/302.2
2,584,883 A * 2/1952 Karsch ..... 200/302.2
3,316,379 A * 4/1967 Clarke et al. ..... 200/302.2
3,821,531 A * 6/1974 Halbach et al. ..... 200/302.2
4,298,778 A * 11/1981 Beresford-Jones ..... 200/302.2
5,413,358 A * 5/1995 Austin, Jr. et al. .... 200/302.2 X
6,207,911 B1 * 3/2001 Hirsch et al. ..... 200/61.81

FOREIGN PATENT DOCUMENTS

JP 5-12956 1/1993

* cited by examiner

*Primary Examiner*—J. R. Scott
(74) *Attorney, Agent, or Firm*—Morgan, Lewis & Bockius LLP

(57) ABSTRACT

A moving member 20 for operating a contact mechanism is provided in a body case 12 in such a manner as to be movable in its projecting and retracting direction. A rubber-made waterproof cap 23 is provided on a front portion of the body case 12 in such a manner as to cover the moving member 20. When a door 31 is closed, the moving member 20 including the rubber cap 23 is pressed by the door 31 to turn off the contact, whereas when the door 31 is opened, the pressing force is canceled to turn on the contact. A distal wall portion of the rubber cap 23 is formed of a low-friction member to form a low-friction portion 23*b*. Consequently, contact surfaces of the rubber cap 23 and the door 31 are formed as low-friction surfaces, and contact surfaces of the rubber cap 23 and the moving member 20 are also formed as low-friction surfaces.

10 Claims, 4 Drawing Sheets

DOOR SWITCH WITH HERMETIC CAP HAVING AN INTEGRALLY MOLDED ABUTMENT PORTION WITH LOW FRICTION RESISTANCE

BACKGROUND OF INVENTION

1. Field of Invention

The present invention relates to a door switch device having a rubber cap for waterproofing which is fitted over a distal end portion of a moving member.

2. Related Art

A door switch device (courtesy lamp switch) for turning on and off, for example, an interior roof lamp as the door of an automobile is opened or closed is arranged such that, as its parts are shown in FIGS. 4 to 6, a moving member 2 made of a hard plastic is provided in a body case 1 having a substantially hollow cylindrical shape and provided with a flange portion 1*a* in its front portion, in such a manner as to be movable in the projecting or retracting direction (in the left-and-right direction in the drawings) so as to be passed through an opening 1*b* thereof. A rubber cap 3 for waterproofing having the shape of a hollow cylindrical cap is attached to a front portion of the flange portion 1*a* so as to be fitted over a distal end portion of the moving member 2.

In this case, the moving member 2 is urged in the projecting direction by a spring in the body case 1, and when a door 4 is opened, the moving member 2 is located at the projecting position shown in FIG. 4, whereas when the door 4 is closed, the moving member 2 is pressed together with the rubber cap 3 by the door 4 and is displaced to the retracted position, as shown in FIG. 5. As a result, a contact mechanism in the body case 1 is operated by the displacement of the moving member 2 between its projecting position and retracted position in correspondence with the opening or closing of the door 4. It should be noted that the rubber cap 3 is shaped in the form of a so-called bellows having a crest and a trough arranged in the axial direction, and the crest portion (large-diameter portion) in the middle is formed as a fold. As the folded portion undergoes expansion and contraction, the rubber cap 3 can be easily deformed resiliently in the projecting or retracting direction of the moving member 2.

The door 4 has vertical free play, though slight, with respect to the body of the automobile, and there are cases where the door 4 vibrates vertically with the door 4 closed during the traveling of the automobile, or becomes slightly offset vertically when the door 4 is opened or closed. However, with the conventional door switch device, there are cases where, owing to the vertical free play or vibration of the door 4, the rubber cap 3 with its distal end surface held in close contact with the door 4 becomes offset vertically by following up the vertical free play or vibration, and undergoes deformation such as to be distorted vertically with the fold bent, as shown in FIG. 6.

When the rubber cap 3 thus undergoes the vertical displacement, the distal end surface of the moving member 2 in the vertically displaced state adheres to the rear surface of the distal end portion of the rubber cap 3. Hence, there have been drawbacks in that even if the door 4 is opened, the rubber cap 3 is difficult to return to its original shape, that the smooth operation of the moving member 2 is possibly hampered, and that breakage can occur in the rubber cap 3 at its portion of contact with the moving member 2.

SUMMARY OF INVENTION

The invention has been devised in view of the above-described circumstances, and its object is to provide a door switch device in which a rubber cap for waterproofing is fitted over a distal end portion of a moving member, and which is capable of effectively preventing the drawbacks ascribable to the displacement of the rubber cap in a direction different to the projecting or retracting direction of the moving member.

According to the present invention, there is provided a door switch device having on a front portion of a body case a moving member adapted to project or retract by the opening or closing of a door so as to operate a contact mechanism as well as a rubber cap for waterproofing which is fitted over a distal end portion of the moving member, provided in that a contact surface of the rubber cap for contact with the door is formed as a low-friction surface having small friction resistance.

According to this arrangement, when the door is closed, the moving member is pressed by the door through the rubber cap and moves in the retracting direction. In this closed state of the door, however, there are cases where the door vibrates or becomes offset, for instance, in the vertical direction with the rubber cap held in close contact with the door. Nevertheless, since the contact surface of the rubber cap for contact with the door is formed as a low-friction surface having small frictional resistance, and the rubber cap is liable to slip on the door, the displacement of the rubber cap accompanying the vibration or offset of the door is unlikely to occur. Accordingly, it is possible to prevent the drawbacks such as that the rubber cap becomes displaced and fails to return to its original shape.

In addition, the door switch according to the present invention is provided a door switch device having on a front portion of a body case a moving member adapted to project or retract by the opening or closing of a door so as to operate a contact mechanism as well as a rubber cap for waterproofing which is fitted over a distal end portion of the moving member, provided in that contact surfaces of the rubber cap and a distal end portion of the moving member are formed as low-friction surfaces having small friction resistance.

According to this arrangement, since the contact surfaces of the rubber cap and a distal end portion of the moving member are formed as low-friction surfaces having small friction resistance, it is possible to prevent the distal end surface of the moving member from adhering to the reverse surface of the rubber cap. In consequence, even when the rubber cap has become vertically displaced due to the vibration or offset of the door when it is closed, the moving member is able to move smoothly in the projecting direction when the door is opened. Accordingly, it is possible to prevent the drawbacks such as that the displacement of the rubber cap hampers the smooth operation of the moving member.

DETAILED DESCRIPTION OF PREFERRED EMBODIMENTS

Figure 1:
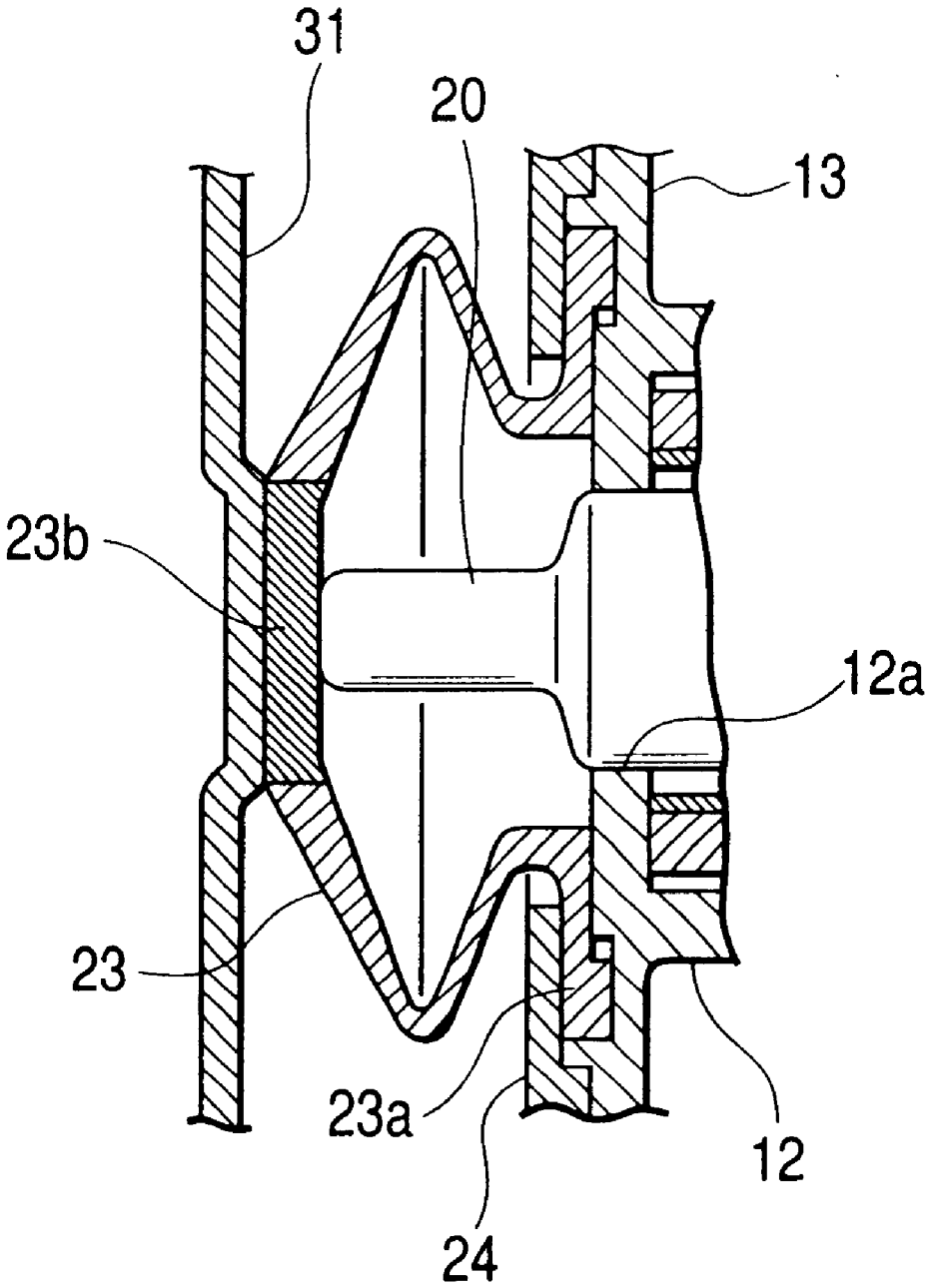
FIG. 1 illustrates an embodiment of the invention and is a vertical side cross-sectional view of a distal end portion of a door switch device with the door closed.
Figure 2:
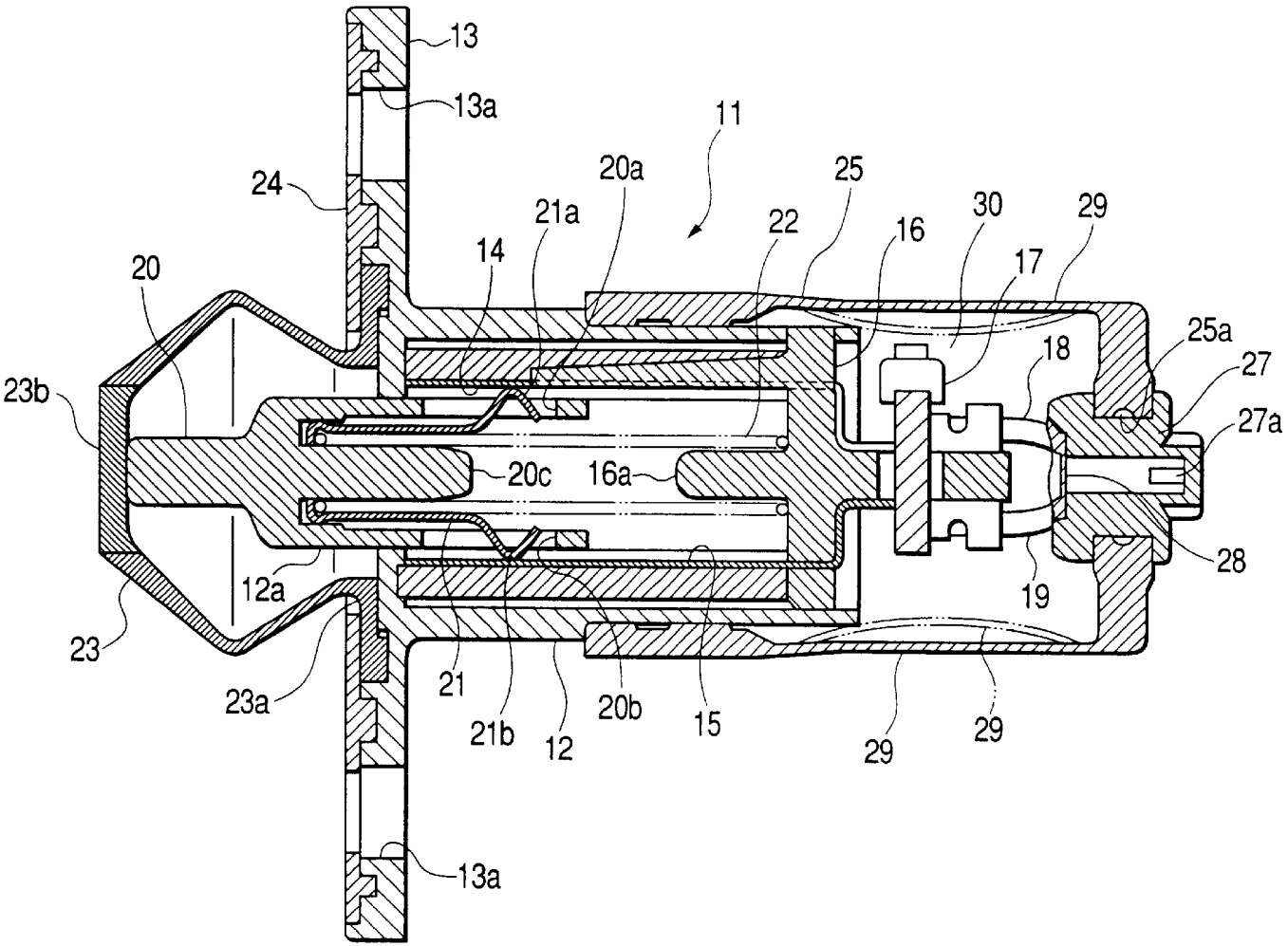
FIG. 2 is a longitudinal cross-sectional plan view of the overall door switch device.
Figure 3:
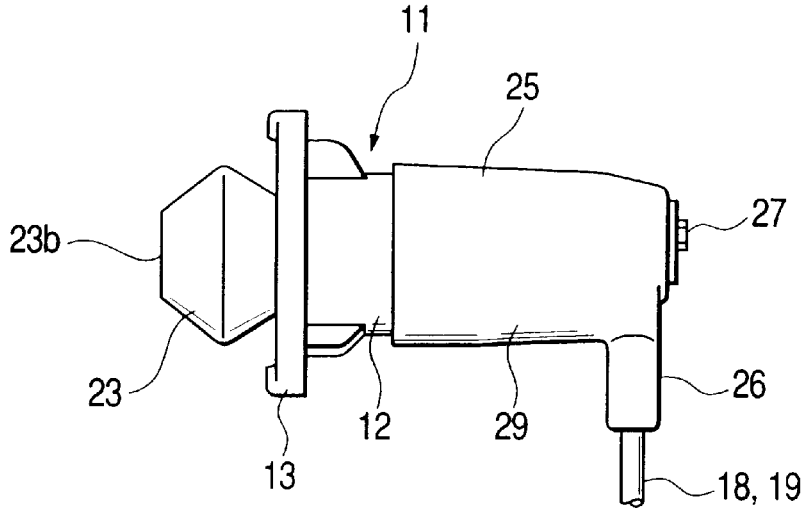
FIG. 3 is a side elevational view illustrating the external appearance of the door switch device.
Figure 4:
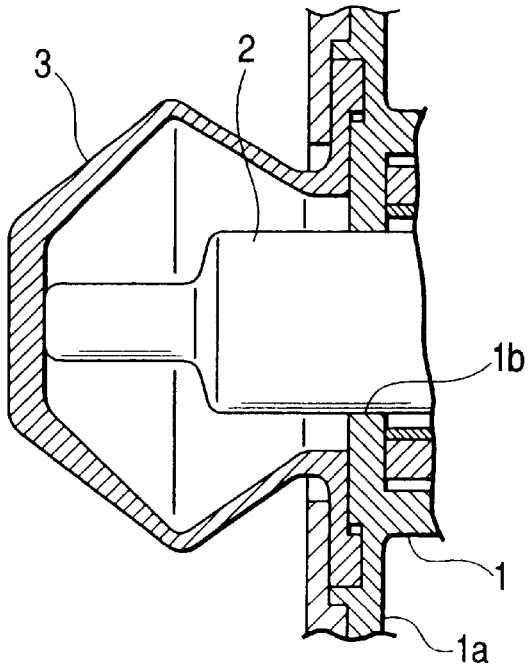
FIG. 4 illustrates a conventional example and is a vertical side cross-sectional view of the distal end portion of the door switch device with the door opened.
Figure 5:
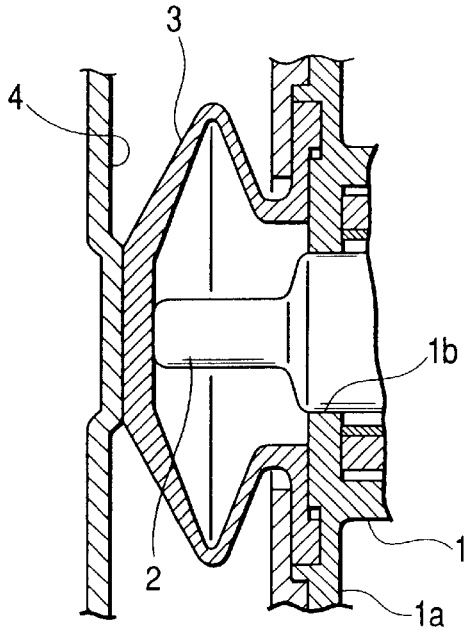
FIG. 5 is a vertical side cross-sectional view of the distal end portion of the door switch device with the door closed.
Figure 6:
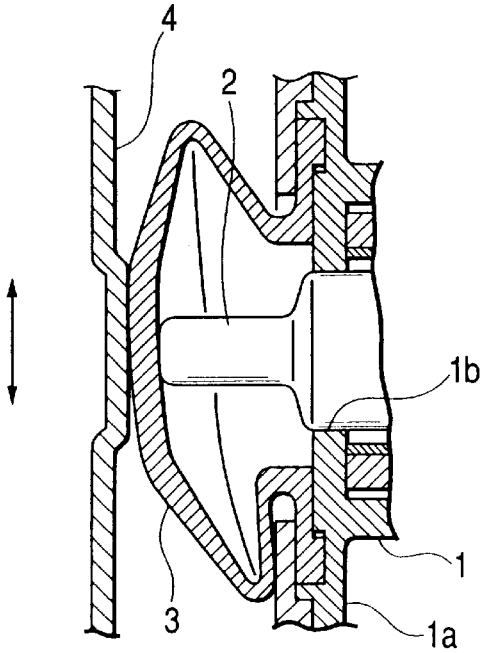
FIG. 6 is a view corresponding to FIG. 5 and illustrating the manner in which a rubber cap has been vertically deformed.

Referring now to FIGS. 1 to 3, a description will be given of an embodiment of the invention. FIGS. 2 and 3 illustrate the overall construction of a door switch device 11 in accordance with the embodiment. Here, a body case 12 made of a plastic has a substantially hollow cylindrical shape, and has in its distal end surface portion (a left-end surface portion in the drawings) an opening 12*a* through which a moving member to be described later is passed through. In addition, a flange portion 13 expanding in a substantially rhombic shape in the radial direction and having two attaching holes 13*a* is integrally formed on a distal end portion of the body case 12.

As shown in FIG. 2, an insulator 16 having a pair of fixed contact plates 14 and 15 on its inner surface is secured in the interior of the body case 12. The fixed contact plates 14 and 15 extend in such a manner as to penetrate a right-hand end face, as viewed in the drawing, of the insulator 16, and are connected to lead wires 18 and 19 through a cable tie 17.

Further, a moving member 20 formed of, for example, a hard plastic is provided in the body case 12 (in the insulator 16). This moving member 20 extends in the left-and-right direction in FIG. 2, its distal end side (left-end side) is formed with a small diameter, while its right-hand side is formed in the shape of a hollow cylindrical cap, which is open at the right end, and is passed through the opening 12*a*. Thus, the moving member 20 is provided in such a manner as to be movable in the projecting and retracting direction (in the left-and-right direction). A movable contact 21 formed of a leaf spring is provided in the moving member 20. The movable contact 21 has a contact portion 21*a* which projects upward in FIG. 2 through an opening 20*a* formed in a peripheral wall portion of the moving member 20 and is moved into contact with and away from the fixed contact plate 14, as well as a contact portion 21*b* which projects downward in the drawing through an opening 20*b* formed in the peripheral wall portion of the moving member 20 and is always in contact with the fixed contact plate 15. A contact mechanism is thus arranged.

The moving member 20 is constantly urged in the projecting direction (leftward in the drawing) by a coil spring 22 whose opposite ends are fitted between a projection 20*c* formed in the hollow portion of the moving member 20 and a projection 16*a* provided in the insulator 16. As a result, as shown in FIG. 2, in the state in which an operating force is not applied from the outside, the distal end of the moving member 20 projects largely from the body case 12, and the contact portion 21*a* of the movable contact 21 is in contact with the fixed contact plate 14, thereby setting the two fixed contact plates 14 and 15 in a conductive state.

In contrast, when the moving member 20 receives a pressing force from the left direction in the drawing, the moving member 20 moves in the retracting direction against the spring force. Then, the contact portion 21*a* is moved away from the fixed contact plate 14, so that the fixed contact plates 14 and 15 are electrically disconnected from each other. When the pressing force is canceled, the moving member 20 moves in the projecting direction by means of the spring force of the coil spring 22, and the fixed contact plates 14 and 15 are set in the conductive state again.

A rubber cap 23 for waterproofing is provided on the front portion of the body case 12. The rubber cap 23 has the shape of a hollow cylindrical cap, and has a flanged portion 23*a* around its opening (a right end portion in the drawing). The rubber cap 23 is fitted to the flange portion 13 of the body case 12 by means of an attaching plate 24 so as to be fitted over a distal end portion of the moving member 20 at the front of the body case 12. The rubber cap 23 has the so-called bellows shape in which an axially intermediate large-diameter portion is formed as a fold, and is easily expanded and contracted so as to be deformed in the retracting direction of the moving member 20 as the large-diameter portion expands and contracts.

Meanwhile, a waterproof cover 25 made of an elastic material such as rubber is provided on the right-hand portion, as viewed in the drawing, of the body case 12. This waterproof cover 25 has a substantially hollow cylindrical shape which is open leftward in FIG. 2, and is attached by being fitted such that its left-hand half is airtightly fitted over the body case 12. As shown in FIG. 3, the lead wires 18 and 19 are airtightly passed through a leading-out portion 26 projecting from a lower portion of the waterproof cover 25, and are led to the outside.

In addition, a through hole 25*a* is formed in the right-end face portion, as viewed in the drawing, of the waterproof cover 25, and a plastic bush 27 is provided in such a manner as to be airtightly fitted in the through hole 25*a*. The bush 27 has a ventilation hole 27*a* for allowing the inner side and the outer side of the waterproof cover 25 (body case 12) to communicate with each other, and is provided with an air-permeable and water-impermeable film 28 such as a Gore-Tex film in such a manner as to cover the ventilation hole 27*a*. This arrangement allows some circulation of air through the film 28 while preventing the entrance of water into the body case 12 including the waterproof cover 25.

Further, the waterproof cover 25 is provided with a pressure-change absorbing portion 29 which undergoes resilient deformation in the expanding and contracting direction in correspondence with a change of the internal pressure of the body case accompanying the movement of the moving member 20. This pressure-change absorbing portion 29 is formed by forming both side portions of a right-hand half portion, as viewed in FIG. 2, of the waterproof cover 25 as being thinner-walled than the other portions.

Consequently, while certain rigidity of the waterproof cover 25 as a whole is being secured, the arrangement provided is such that as the pressure-change absorbing portion 29 undergoes resilient deformation in the contracting direction as shown by the two-dotted dash lines in FIG. 2, the change in the internal pressure is absorbed, and as the state of negative pressure is overcome, the pressure-change absorbing portion 29 undergoes returning deformation in the expanding direction. In addition, a space portion 30 for allowing the compressive deformation of the pressure-change absorbing portion 29 is provided between the body case 12 and the waterproof cover 25, so that the resilient deformation of the pressure-change absorbing portion 29 in the compressing direction can be easily and speedily effected at this time.

A major portion of the rubber cap 23 is formed of rubber. In this embodiment, however, as shown in FIGS. 1 and 2 with the directions of hatching varied, only the distal wall portion of the rubber cap 23, i.e., the portion where the distal end portion of the moving member 20 comes into contact and which abuts against a door 31 which will be described later, is formed as a low-friction portion 23*b* formed of a low-friction material having small frictional resistance, e.g., fluorocarbon resin (Teflon). As a result, the contact surfaces of the rubber cap 23 and the door 31 are formed as low-friction surfaces having small frictional resistance, and the contact surfaces of the rubber cap 23 and the distal end portion of the moving member 20 are also formed as low-friction surfaces having small frictional resistance. It should be noted that, in this case, this rubber cap 23 can be integrally formed by so-called two-color molding.

Next, a description will be given of the operation of the above-described arrangement. The door switch device 11 constructed as described above is built into the body of the automobile as a switch for detecting the opening or closing of the door 31 of the automobile. In this case, although not shown, the door switch device 11 is disposed in series in an energizing electric path of, for example, an interior roof lamp (door lamp). As shown in FIG. 1, when the door 31 is closed, the moving member 20 is pressed by the door 31 to turn off the contact, thereby turning off the interior roof lamp. Meanwhile, as shown in FIG. 2, when the door 31 is opened, the pressing force against the moving member 20 is canceled to turn on the contact, thereby turning on the interior roof lamp.

At this time, as shown in FIG. 1, the pressing of the moving member 20 by the door 31 is effected via the rubber cap 23 (beyond the rubber cap 23), and when the door 31 is closed, the rubber cap 23 assumes a state in which its large-diameter portion (folded portion) is bent, i.e., in a state of being collapsed in the axial direction of the moving member 20. Meanwhile, when the door 31 is opened, as shown in FIG. 2, the rubber cap 23 is returned to a state in which its folded portion is extended more than that (assumes an obtuse angle). Incidentally, it goes without saying that this rubber cap 23 makes it possible to prevent such as water and dust from entering the interior of the body case 12 through its opening 12*a* and adversely affecting the contact mechanism and the like.

However, the door 31 has vertical free play, though slight, with respect to the body of the automobile, and the situation is such that the door 31 vibrates vertically with the door 31 closed during the traveling of the automobile, or becomes offset vertically when the door 31 is opened or closed. Here, as shown in FIG. 1, in the closed state of the door 31, since the distal end surface of the rubber cap 23 is in close contact with the door 31, if the frictional resistance of the contact surfaces of the rubber cap 23 and the door 31 is large, there is a possibility that the rubber cap 23 becomes displaced vertically in a direction different to the projecting or retracting direction of the moving member 20 by following up the vertical displacement of the door 31, and undergoes deformation such as to be distorted vertically with the fold bent. Further, since the rubber cap 23 is brought into pressure contact with the distal end surface of the moving member 20, if the frictional resistance of the contact surfaces of the rubber cap 23 and the moving member 20 is large, the distal end surface of the moving member 20 possibly adheres to the rear surface of the rubber cap 23.

However, in this embodiment, the distal wall portion of the rubber cap 23 is formed as the low-friction portion 23*b* formed of a material having small frictional resistance, so that the contact surfaces of the rubber cap 23 and the door 31 are formed as low-friction surfaces. Hence, the rubber cap 23 is liable to slip on the door 31, with the result that the vertical displacement of the rubber cap 23 accompanying the vibration or offset of the door 31 is unlikely to occur. Further, since the contact surfaces of the rubber cap 23 and the distal end portion of the moving member 20 are also formed as low-friction surfaces, the distal end surface of the moving member 20 is prevented from adhering to the rear surface of the rubber cap 23.

Therefore, in accordance with the embodiment, even if the door 31 vibrates or becomes offset in the vertical direction different from the projecting or retracting direction of the moving member 20, it is possible to prevent the occurrence itself of the vertical displacement of the rubber cap 23 as practically as possible. Furthermore, it is possible to prevent the moving member 20 from adhering to the rubber cap 23. Accordingly, unlike the conventional door switch device which has drawbacks in that even if the door 4 is opened, the rubber cap 3 is difficult to return to its original shape and hampers the smooth operation of the moving member 2, and that breakage can occur in the rubber cap 3 at its portion of contact with the moving member 2, an outstanding advantage can be obtained in that it is possible to prevent the drawbacks ascribable to the displacement of the rubber cap 23 in a direction different to the projecting or retracting direction of the moving member 20.

It should be noted that although, in the above-described embodiment, the low-friction portion 23*b* is provided by forming a portion of the rubber cap 23 of a low-friction material, a low-friction surface may be provided by bonding sheets of a low-friction material (e.g., Teflon sheets) to both surfaces of the distal wall portion of the rubber cap formed of rubber.

In addition, the intended object can be also attained by forming only the contact surfaces of the rubber cap and the door as low-friction surfaces or by forming only the contact surfaces of the rubber cap and the moving member as low-friction surfaces. In this case, in the case where the contact surfaces of the rubber cap and the moving member are formed as low-friction surfaces, a low-friction sheet may be bonded to the distal end surface of the moving member. Furthermore, various modifications are possible with respect to the construction of the contact mechanism, the waterproofing cover, and the like, and the invention may be implemented by being appropriately modified within the scope which does not depart from the gist of the invention.

As is apparent from the foregoing description, in accordance with the door switch device of the invention, in the door switch device in which the rubber cap for waterproofing is fitted over the distal end portion of the moving member, since the contact surface of the rubber cap for contact with the door is formed as a low-friction surface having small friction resistance, or since the contact surfaces of the rubber cap and the distal end portion of the moving member are formed as low-friction surfaces having small friction resistance, an outstanding advantage can be obtained in that it is possible to prevent the drawbacks ascribable to the displacement of the rubber cap in a direction different to the projecting or retracting direction of the moving member.

What is claimed is:

1. A door switch device having on a front portion of a body case comprising:

a moving member projecting or retracting by the opening or closing of a door so as to operate a contact mechanism;

a rubber cap for waterproofing fitted over a distal end portion of said moving member; and a contact surface, defined by contacting said rubber cap with said door, formed by a material having small friction resistance.

2. A door switch device having on a front portion of a body case comprising:

a moving member projecting or retracting by the opening or closing of a door so as to operate a contact mechanism;

a rubber cap for waterproofing fitted over a distal end portion of said moving member; and a contact surface, defined by contacting said moving member and said rubber cap, formed by a material having small friction resistance.

3. A door switch device having on a front portion of a body case comprising:

a moving member projecting or retracting by the opening or closing of a door so as to operate a contact mechanism;

a waterproof cap fitted over a distal end portion of said moving member the waterproof cap having an interior surface and an exterior surface; and a first contact surface being located at the distal end of the movable member;

a second contact surface being located on the interior surface of the waterproof cap, and the second contact surface engaging the first contact surface at an interior contact region;

a third contact surface being located on the exterior surface of the waterproof cap; and a fourth contact surface located on the door facing, and the fourth contact surface engaging the third contact surface at an exterior contact region;

wherein at least one of the interior and exterior contact regions has low frictional resistance.

4. The door switch device according to claim 3, wherein the second and third contact surfaces comprise a material having low frictional resistance.

5. The door switch device according to claim 3, wherein at least one of the first, second, third, and fourth contact surfaces comprises a material having a low frictional resistance.

6. The door switch device according to claim 5, wherein the material having a low frictional resistance comprises a fluorocarbon resin.

7. The door switch device according to claim 6, wherein the material having a low frictional resistance comprises polytetrafluoroethylene.

8. The door switch device according to claim 7, wherein the material having a low frictional resistance comprises Teflon™.

9. The door switch device according to claim 5, wherein the material having a low frictional resistance comprises a bonding sheet.

10. The door switch device according to claim 5, wherein the material having a low frictional resistance comprises a Teflon™ bonding sheet.

* * * * *